US005348049A

United States Patent [19]

Yonekubo et al.

[11] Patent Number: 5,348,049

[45] Date of Patent: Sep. 20, 1994

[54] INPUT APPARATUS

[75] Inventors: Yoshitake Yonekubo, Tokyo; Hideshi Koiwai, Toda; Susumu Narita, Sagamihara, all of Japan

[73] Assignee: Kayaba Industry Co., Ltd., Tokyo, Japan

[21] Appl. No.: 991,567

[22] Filed: Dec. 16, 1992

Related U.S. Application Data

[62] Division of Ser. No. 875,642, Apr. 29, 1992, Pat. No. 5,251,534.

[51] Int. Cl.[5] ..... F15B 13/02

[52] U.S. Cl. ..... 137/636.2; 91/426; 137/636.1

[58] Field of Search ..... 91/426; 137/636.1, 636.2

[56] References Cited

U.S. PATENT DOCUMENTS 4,461,320 7/1984 Barbagli ..... 137/636.2 X
4,566,492 1/1986 Bessard ..... 137/636.2 X
4,777,981 10/1988 Petro ..... 137/636.2
4,827,982 5/1989 Inagaki ..... 137/636.1

*Primary Examiner*—Gerald A. Michalsky
*Attorney, Agent, or Firm*—Thomas R. Morrison

[57] ABSTRACT

An input apparatus capable of concurrently accommodating itself to any external signal from a different hydraulic control system or the like. The apparatus includes electrical load sensors each arranged on a push rod or block for detecting the amount of operation of a control lever to generate an electrical signal corresponding to the amount of operation of the control lever. Also, an input apparatus which is capable of concurrently responding to both a signal generated by itself and an external signal fed thereto is provided. The apparatus includes a pilot section for exerting force which permits a shuttle to be moved against coiled compression springs. The pilot section is fed with a signal from an external hydraulic control system.

2 Claims, 7 Drawing Sheets

INPUT APPARATUS

This is a divisional of co-pending application Ser. No. 07/875,642 filed on Apr. 29, 1992, now U.S. Pat. No. 5,251,534.

BACKGROUND OF THE INVENTION

This invention relates to an input apparatus adapted to be mounted on a machine equipped with a plurality of actuator driving circuits such as a civil engineering equipment, a construction equipment or the like. Also, the present invention relates to an input apparatus adapted to control its output by means of an external signal input thereto as well as by operation through its .own control section.

In general, manual operation of a hydraulic driving circuit equipped with a plurality of actuators and arranged in a machine such as a construction equipment or the like has been conventionally carried out by means of a hydraulic joy stick which is a kind of input apparatus.

Such an input apparatus is generally constructed in such a manner as shown in FIG. 1. More particularly, the input apparatus which is a hydraulic type includes a body 10 and a control lever 12 mounted on a central position of an upper portion of the body 10 so as to act as a control section. The control lever 12 is arranged so as to be inclinedly moved in two directions perpendicular to each other or X and Y directions. Also, on the body 10 are four push rods 14, which comprise one set of two push rods 14 arranged in an X direction and the other set of two push rods 14 arranged in a Y direction perpendicular to the X direction. Each set of push rods 14 corresponds to each one actuator (not shown). Thus, it will be noted that the input apparatus shown in FIG. 1 is so constructed that the single control lever 12 operates two actuators.

The body 10 is formed therein with a chamber 16 in correspondence to each of the push rods 14 in a manner to be positioned below the push rod. In each of the chambers 16 is arranged a block 18, which is operatively connected at an upper end thereof to the push rod 14 and provided on a lower end thereof with a plate 20. To the plate 20 is operatively connected a spool 22 in a manner to be vertically movable, which spool 22 is formed in a lower portion thereof with a passage 24. The passage 24 is formed at an upper portion thereof with a port 26 which communicates with an exterior of the input apparatus as described below.

The spool 22 has a support member 28 securely fitted on an intermediate portion thereof. Another support member 30 is fixedly arranged on the above-described lower end of the block 18 in a manner to surround the plate 20. Each of the chambers 16 is also provided therein with a coiled spring 32 so as to be interposedly arranged between the support member 30 and a bottom of the chamber 16. Another coiled spring 34 is arranged between the support member 28 and the support member 30 in a manner to be position inside the first spring 32 and a further coiled spring 36 is arranged inside the coiled spring 34. The body 10 is formed with a pump port 38, as well as a hydraulic oil feed passage 40 communicating with the pump port 38. Also, the body 10 is provided at a portion thereof below each of the spools 22 with an output port 42 communicating with an actuator (not shown).

In FIG. 1, only two push rods 14 and the construction associated therewith are shown, however, the other two push rods (not shown) are constructed in the same manner.

Now, the manner of operation of the conventional input apparatus constructed as described above will be described hereinafter.

Supposing that the control lever 12 is operated to downward force the push rod 14 shown on the right side in FIG. 1, the push rod 14 is downward moved to compress the coiled springs 32 and 34 through the plate 20 and support member 30 and downward push the spool 22. Such lowering of the spool 22 permits the port 26 of the spool 22 to communicate with the hydraulic oil feed passage 40, resulting in pressure or hydraulic oil being discharged through the port 26, passage 24 and output port 42 to the actuator (not shown). Also, such flowing of the hydraulic oil concurrently leads to generation of force which causes the spool 22 to be upward forced. The force thus generated is balanced with elastic force of the coiled spring 34, so that a pressure under which the hydraulic oil is discharged through the output port 42 is determined in association with the push rod 14.

The above-described operation is likewise carried out also when the control lever 12 is further operated in the same direction to compress the coiled spring 36. In this instance, elastic force of the coiled springs 34 and 36 and the above-described force for upward biasing the spool 22 are balanced with each other.

Unfortunately, the above-described construction of the conventional input apparatus restricts the apparatus to generation of only a hydraulic signal. Thus, it is required to provide an electrical input apparatus separate from the hydraulic input apparatus when it is desired to control an electrical actuator actuated by an electrical signal, in addition to controlling of a hydraulic actuator by a hydraulic signal.

Also, even when it is possible to provide such an electrical input apparatus separate from the hydraulic input apparatus as described above, an operator must be skilled in order to concurrently operate both input apparatus in association with each other.

A conventional input apparatus of another type is shown in FIG. 2, which is constructed in the form of a pilot valve used for various industrial equipments. The input apparatus of FIG. 2 includes a body 100, which is formed therein with four chambers 102 as in the apparatus shown in FIG. 1, although FIG. 2 shows only two such chambers. The chambers 102 each are continuously formed at a lower portion thereof with a passage 104 and an output port 106 in a manner to communicate with each other. In the chamber 102 is arranged a shaft member 108 in a manner to vertically movable therein. The shaft member 108 is fittedly provided on an outer periphery of an upper end thereof with a support member 110 and on an outer periphery of a lower end thereof with a support member 112, and between both support members 110 and 112 is interposedly arranged a coiled spring 114 acting as a part of elastic means. Also, the chamber 102 is provided therein a further support member 116 in a manner to be positioned below the support member 112, and between the support member 116 and a lower end or bottom of the chamber 102 is arranged a compression spring 118 in the form of a coiled spring so as to serve as another part of the elastic means. The remaining three chambers are constructed in the same manner.

The input apparatus also includes a push rod 120 vertically movably arranged above each of the shaft members 108. Above the four push rods 120 is commonly arranged a press member 122 acting as a part of a control section, and to the press member 122 is operatively connected a lever 124 acting as another part of the control section. The push rods 120, the press member 122 and a lower portion of the lever 124 are surrounded with a bellows-like cover 126.

In each of the passages 104 is arranged a shuttle 128 in a manner to be vertically slidable therein. The shuttle 128 is provided on a side wall thereof with a pair of lower and upper passages 130 and 132 in a manner to laterally extend and be vertically spaced from each other and also provided therein with a vertically extending passage 134 so as to communicate with the lateral passages 130 and 132. The vertical passage 134 is arranged so as to communicate with the output port 106. In addition, the body 100 is formed therein with a pump passage 136, to which a hydraulic pump 138 is connected. The body 100 is also formed therein with a tank passage 140, to which a tank 142 is connected. FIG. 3 shows a circuit of the input apparatus or pilot valve thus constructed.

In the pilot valve constructed as described above, supposing that the lever 124 is operated to forcedly lower the push rod 120 shown on the right side of FIG. 2, the push rod 120 is downward pushed to compress the coiled compression spring 118 and downward move the shuttle 128. Such lowering of the shuttle 128 permits the passage 130 to communicate with the pump passage 136, so that pressure or hydraulic oil from the hydraulic pump 138 is fed through the pump passage 136, passage 130 and passage 134 to the output port 106.

At this time, a back pressure from the side of the output port 106 acts on a pressure receiving surface 144 which is a lower end surface of the shuttle 128, so that the back pressure and elastic force of the coiled compression springs 114 and 118 are balanced with each other to control a position of the shuttle 128 and therefore hydraulic oil discharged from the output port 106. When the back pressure acting on the pressure receiving surface 144 of the shuttle 128 is increased, the shuttle 128 is pushed down to a position at which the passage 132 of the shuttle 128 communicates with the tank passage 140, resulting in hydraulic oil being returned through the passages 132 and 140 to the tank 142.

As can be seen from the foregoing, the conventional input apparatus or pilot valve constructed as described above is adapted to output hydraulic pressure of a predetermined level depending on the amount of operation of the lever 124 to the output port 106.

Unfortunately, the input apparatus completely fails to control its output by means of an external signal such as a hydraulic signal output from a different or external hydraulic control system or the like, to thereby fail to operate in association with the external hydraulic control system.

The present invention has been made in view of the foregoing disadvantages of the prior art.

Accordingly, it is an object of the present invention to provide an input apparatus which is capable of concurrently outputting both a hydraulic signal and an electrical signal.

It is another object of the present invention to provide an input apparatus which is capable of permitting an operator to readily accomplish both hydraulic control and electrical control in association with each other substantially without requiring skill.

It is a further object of the present invention to provide an input apparatus which is capable of concurrently accommodating itself to an any external signal from a different or external hydraulic control system or the like.

It is still another object of the present invention to provide an input apparatus which is capable of concurrently responding to both a signal generated by itself and an external signal fed thereto.

In accordance with one aspect of the present invention, an input apparatus is provided which comprises a control section, a body, a plurality of sets of push rods arranged in the body in a manner to correspond to a plurality of actuators and commonly operatively connected to the control section, the sets each comprising two push rods, a block and elastic means arranged in the body and operatively connected to each of the push rods, a spool arranged in the body and operatively connected through the block and elastic means to each of the push rods, the body being formed therein with a hydraulic oil feed passage, the spool being formed with a passage, whereby the control section is pressedly operated to force each of the spools through the push rod, block and elastic means to permit the hydraulic oil feed passage of the body and the passage of the spool to communicate with each other to feed the actuator with hydraulic oil and balance force generated due to flowing of hydraulic oil and acting to forcedly return the spool with elastic force of the elastic means to position the spool depending on the amount of operation of the control section, to thereby feed hydraulic oil in an amount corresponding to the amount of operation of the control section to the actuator. The input apparatus is featured in that it further comprises electrical load sensors for detecting the amount of operation of the control section to generate an electrical signal corresponding to the amount of operation of the control section.

In accordance with another aspect of the present invention, an input apparatus is provided which comprises a control section, a body formed with a pump passage and an output port, push rods arranged in the body and operatively connected to the control section, elastic means arranged in the body and operatively connected to each of the push rods, a shuttle arranged in the body and operatively connected to each of the push rods, the shuttle having a pressure receiving surface and being formed with a passage, whereby pressing operation of the control section causes the shuttle to be moved through the push rod in one direction against the elastic means to permit the passage of the shuttle with the pump passage of the body, resulting in feeding hydraulic oil from a hydraulic pump through the shuttle to the output port of the body and balancing a back pressure acting on the pressure receiving surface of the shuttle through the output port and elastic force of the elastic means with each other to determine a position of the shuttle and therefore a hydraulic pressure output through the output port depending on the amount of operation of the control section. The input apparatus is featured in that it further comprises a pilot section for exerting force which permits the shuttle to be moved against the elastic means and the pilot means is fed with a signal from a different hydraulic control system.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, an input apparatus according to the present invention will be described hereinafter with reference to the accompanying drawings.

Figure 4:
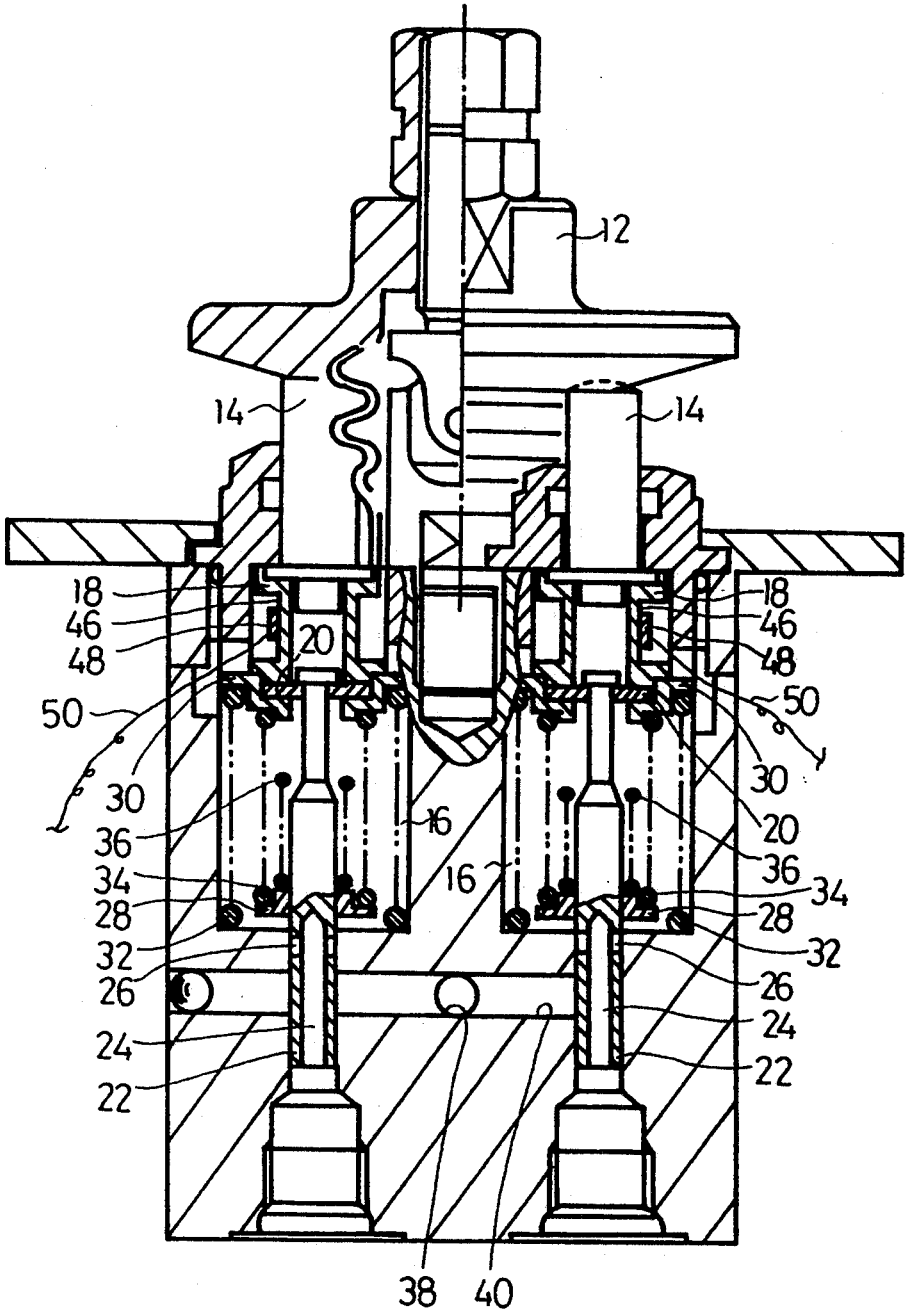
FIG. 4 is a vertical sectional view showing an embodiment of an input apparatus according to the present invention.

FIG. 4 shows an embodiment of an input apparatus according to the present invention. An input apparatus shown in FIG. 4 is adapted to eliminate the disadvantage encountered with the conventional input apparatus described above with reference to FIG. 1. Therefore, reference numerals like those in FIG. 1 are used in FIG. 4 to indicate parts corresponding to the parts shown in FIG. 1.

Figure 1:
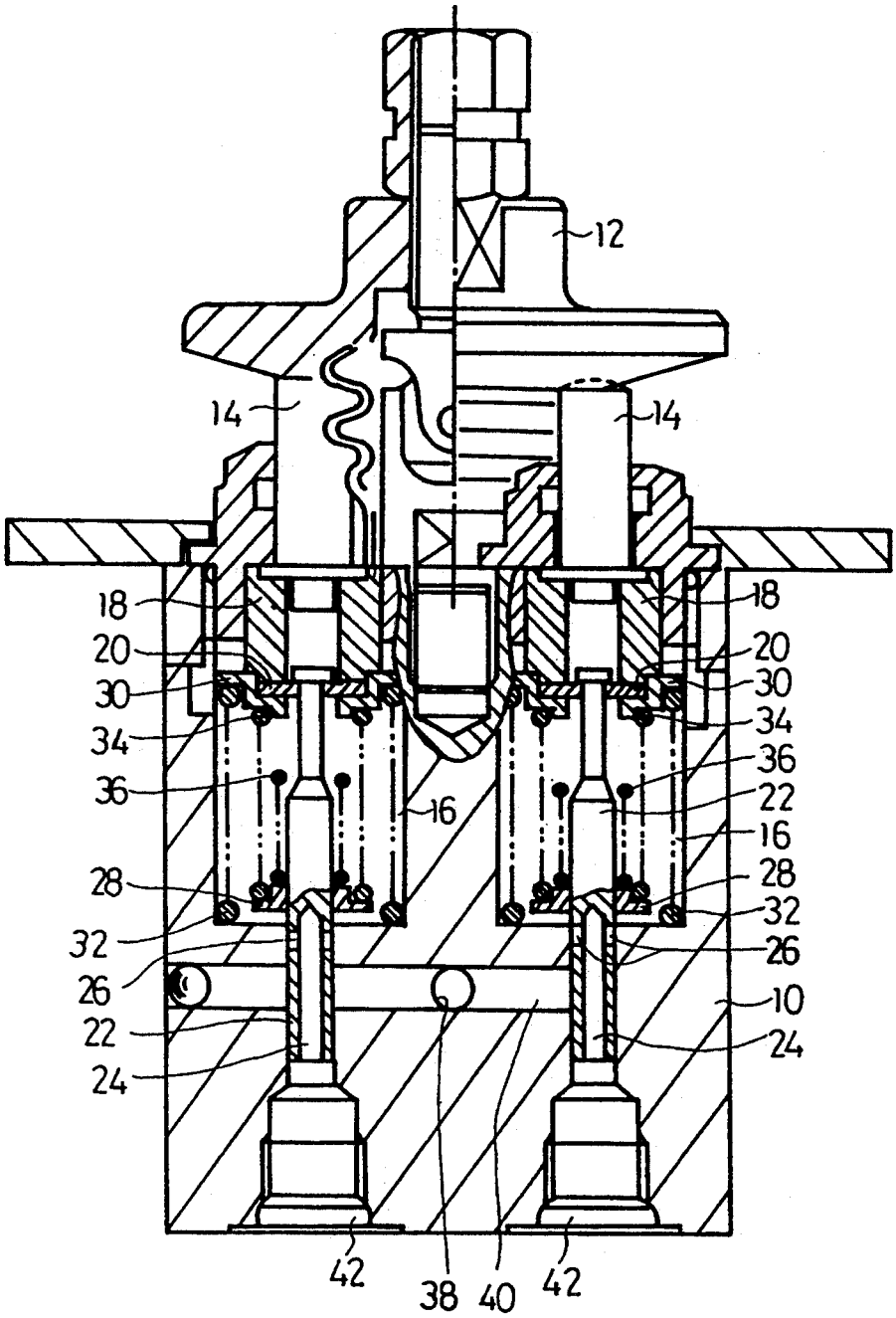
FIG. 1 (PRIOR ART)
FIG. 1 is a vertical sectional view showing a conventional input apparatus.

The input apparatus of the illustrated embodiment includes four blocks 18 arranged in substantially the same manner as in the prior art shown in FIG. 1. The blocks 18 each are formed on an outer surface thereof with an annular recess or groove 46 so as to extend in a circumferential direction thereof. In the groove 46 is arranged an electrical load sensor 48. For this purpose, a load cell utilizing a strain gage may be used for the load sensor 48. A signal generated from the load sensor 48 is output through a signal cable 50 and used to electrically control another equipment. More particularly, the load sensor 48 detects a load value corresponding to the amount of operation of a control lever 12, to thereby generate an output signal corresponding thereto.

As described above, in the illustrated embodiment, the load sensor 48 is arranged on each of the blocks 18. However, it may be arranged on each of the push rods 14.

The remaining part of the input apparatus of the illustrated embodiment may be constructed in substantially the same manner as the conventional input apparatus shown in FIG. 1.

Now, the manner of operation of the input apparatus of the illustrated embodiment will be described hereinafter.

As will be noted from the foregoing, a basic construction of the input apparatus is hydraulic and a plurality of actuators are actuated by means of the single control section or control lever 12. More specifically, operation of the control lever 12 operated in a desired amount in a desired direction permits any desired set of push rods 14 to be downward pressed, so that each of spools 22 corresponding to the push rods 14 is forcedly downward pressed through the block 18 and elastic members or coiled springs 32 and 34. This results in a passage 24 formed in the spool 22 communicating with a hydraulic oil feed passage 40 formed in a body 10, so that hydraulic oil may be fed to an actuator (not shown).

Concurrently, such flowing of hydraulic oil causes generation of force acting to forcedly return the spool 22 toward its original position, so that the force and elastic force of the elastic members are balanced with each other to determine a position of the spool 22 depending on the amount of operation of the control lever 12. This permits hydraulic oil in an amount depending on the amount of operation of the control lever 12 to be fed to the actuator.

Also, the electrical load sensor 48 mounted on the push rod 14 or block 18 concurrently generates an electrical signal depending on the amount of operation of the control lever 12, which is then used for electrically controlling a different equipment.

As can be seen from the foregoing, the input apparatus of the illustrated embodiment exhibits a function as an electrical input apparatus while exhibiting advantages of a hydraulic input apparatus. Also, the illustrated embodiment provides a desired input apparatus without substantially varying the conventional input apparatus and more specifically without varying a size of the prior art, its configuration and the like, so that it may be conveniently combined with different equipments.

Thus, the input apparatus of the illustrated embodiment simultaneously generates both a hydraulic signal and an electrical signal through operation of the single control lever, of which output values are determined depending on the amount of operation of the single control lever. Thus, an operator can readily concurrently operate an equipment controlled by the hydraulic signal and that controlled by the electrical signal in association with each other without requiring skill.

Figure 2:
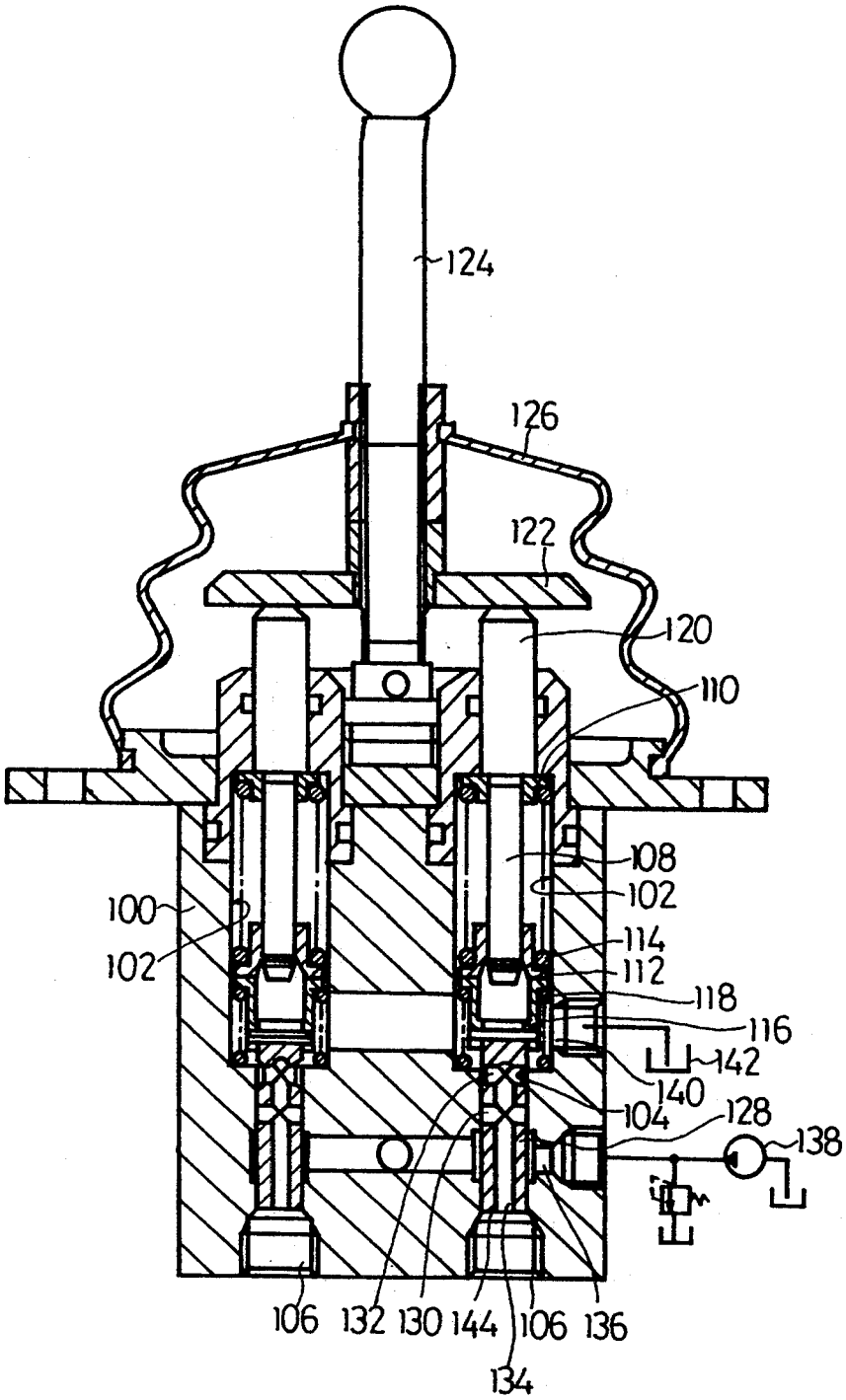
FIG. 2 (PRIOR ART)
FIG. 2 is a vertical sectional view showing a conventional input apparatus of another type.
Figure 3:
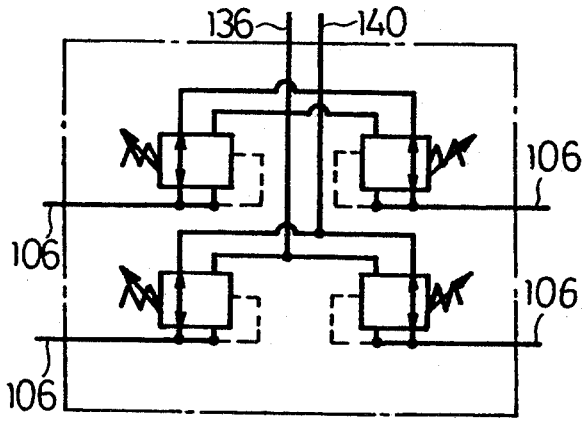
FIG. 3 (PRIOR ART)
FIG. 3 is a circuit diagram of the conventional input apparatus shown in FIG. 2.
Figure 5:
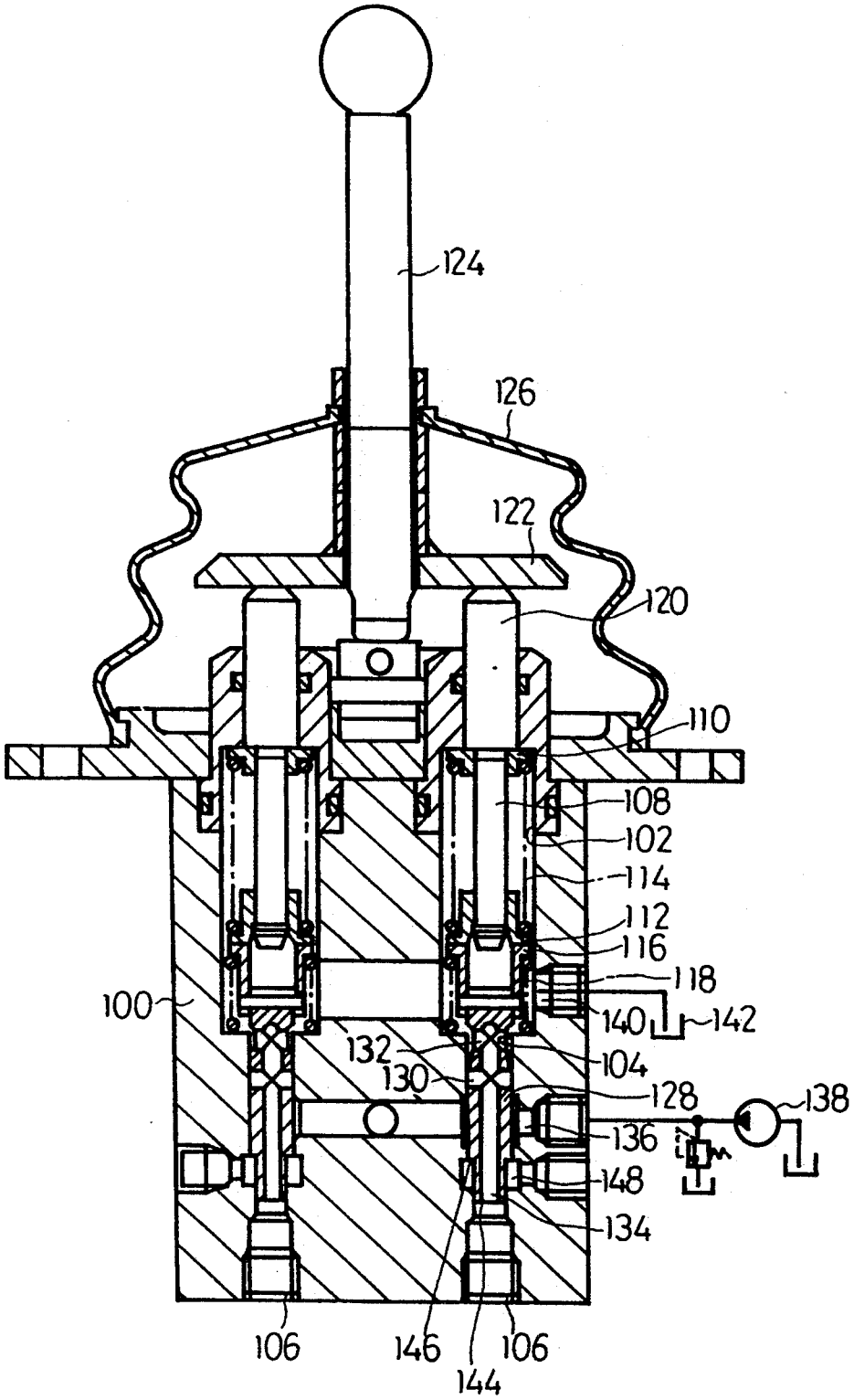
FIG. 5 is a vertical sectional view showing another embodiment of an input apparatus according to the present invention.

FIG. 5 shows another embodiment of an input apparatus according to the present invention, which is constructed in the form of a pilot valve. An input apparatus of the illustrated embodiment is adapted to eliminate disadvantages encountered with the conventional input apparatus described with reference to FIGS. 2 and 3. Therefore, reference numerals like those in FIG. 2 are used in FIG. 5 to indicate parts corresponding to the parts shown in FIG. 2. In the input apparatus or pilot valve shown in FIG. 5, a shuttle 128 is formed on an outer surface of a lower portion thereof into a reduced diameter, resulting in being provided with a step which serves as another pressure receiving surface 146. Correspondingly, a body 100 is formed therein with an external hydraulic signal passage 148 acting as a pilot section, to which an external hydraulic signal is selectively input from a different or external hydraulic control system or the like.

The remaining part of the illustrated embodiment may be constructed in substantially the same manner as the conventional input apparatus or pilot valve shown in FIG. 2.

In the input apparatus of FIG. 5 constructed as described above, a hydraulic control operation may be carried out in the same manner as the prior art described above. Operation of a control section or control lever 124 causes the shuttle 128 to be moved through the corresponding push rod 120 and shaft member 108 in one direction. This results in a passage 130 of the shuttle 128 and a pump passage 136 of the body 100 communicating with each other, so that hydraulic oil from a hydraulic pump 138 is fed through the shuttle 128 to an output port 106 of the body 100. At this time, a back pressure acts on a pressure receiving surface 144 of the shuttle 128 through the output port 106, so that the back pressure and elastic force of elastic means 114 and 118 are balanced with each other to determine a position of the shuttle 128 and therefore hydraulic pressure output through the output port 106 depending on the amount of operation of the control lever 124.

Then, supposing that an external hydraulic signal is fed from a different or external hydraulic control system through the external hydraulic signal passage 148 to the input apparatus of the illustrated embodiment during the hydraulic control operation, hydraulic pressure acts on the pressure receiving surface 146 of the shuttle 128 to exert force for upward pushing it. The force and elastic force of the coiled compression coils 114 and 118 are balanced with each other to reduce hydraulic pressure output through the output port 106. Thus, it will be noted that the illustrated embodiment permits the external hydraulic signal to control hydraulic pressure output through the output port 106. Therefore, the input apparatus of the illustrated embodiment is actuated by means of the external hydraulic signal from the different hydraulic control system as well as through operation by its own control section, resulting in providing a multi-functional pilot valve.

Figure 6:
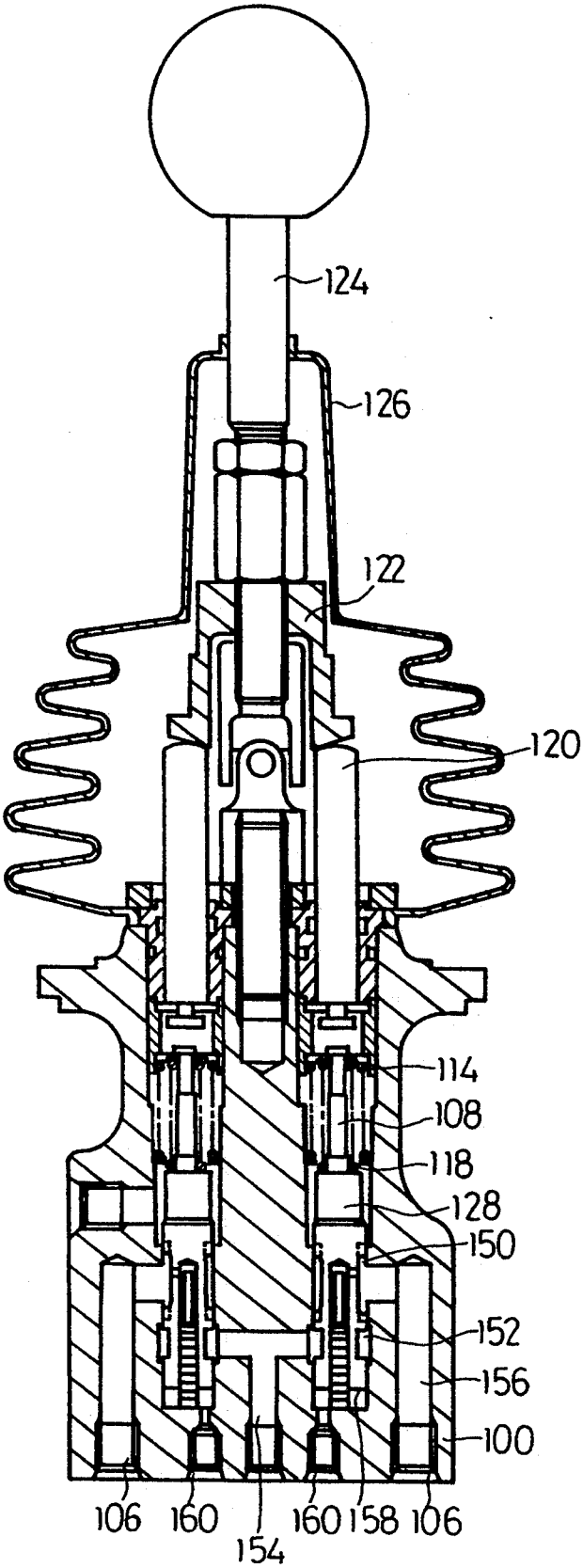
FIG. 6 is a vertical sectional view showing a modification of the input apparatus of FIG. 5.

Referring now to FIG. 6, a modification of the input apparatus shown in FIG. 5 is illustrated. An input apparatus shown in FIG. 6 is constructed in substantially the same manner as the embodiment of FIG. 5, except arrangement of passages in a body and that of a shuttle. More particularly, a shuttle 128 is formed on an outer periphery thereof with an upper passage 150 and a lower passage 152 vertically spaced from one another. A body 100 is formed therein with a pump passage 154 and a passage 156. A relationship is established between the passages 150 and 152 of the shuttle 128 and the passages 154 and 156 of the body 100 so that during normal operation, lowering of the shuttle 128 causes the pump passage 154 and passage 156 to communicate with each other through the upper passage 150 to permit hydraulic oil to be fed from a hydraulic pump 138 (FIG. 5). On the contrary, when an external hydraulic signal acts on a pressure receiving surface 158 of the shuttle 128 from a different or external hydraulic control system (not shown) or the like through an external hydraulic signal passage 160, the shuttle 128 is upward moved correspondingly to decrease feeding of hydraulic oil through the passage 150. Thus, it will be noted that the modification likewise permits hydraulic oil fed through an output port 106 to be controlled by means of an external hydraulic signal fed through the external hydraulic signal passage 160.

The remaining part of the modification may be constructed in substantially the same manner as the embodiment of FIG. 5.

Figure 7:
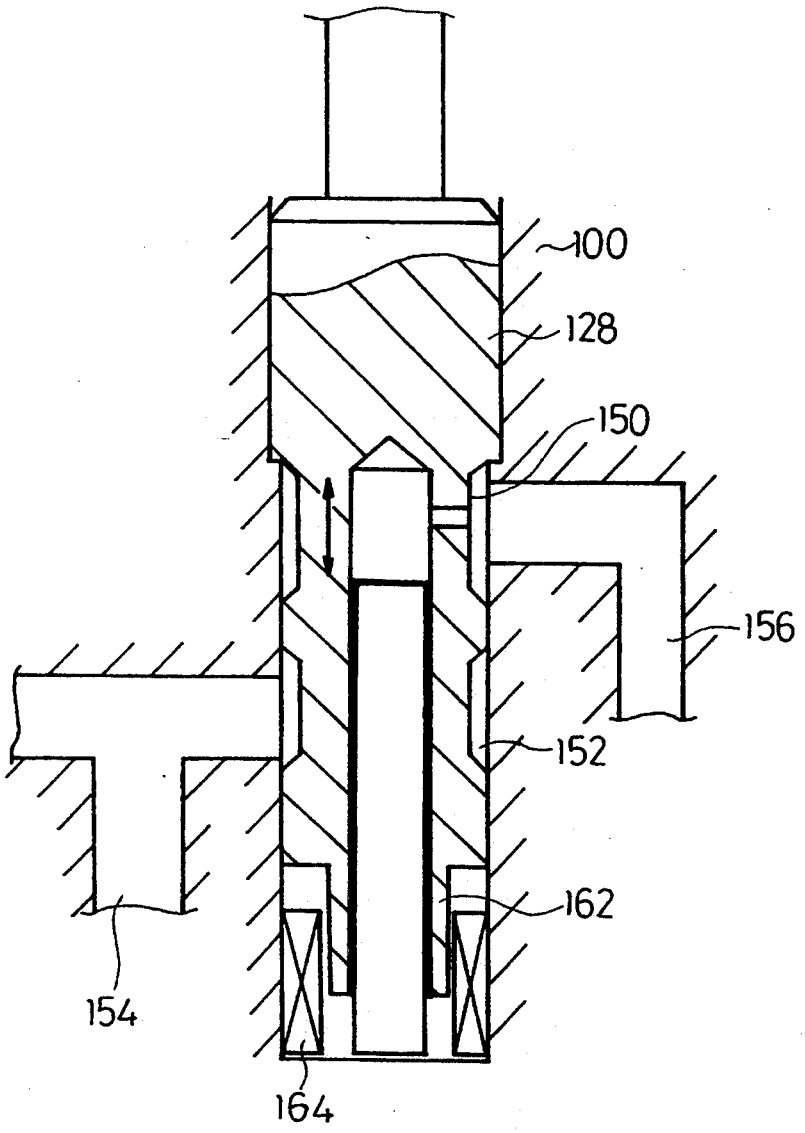
FIG. 7 is a vertical sectional view showing another modification of the input apparatus of FIG. 5.

FIG. 7 shows another modification of the embodiment shown in FIG. 5. The input apparatus or pilot valve shown in each of FIGS. 5 and 6 is so constructed that the external hydraulic signal passage 148 acting as the pilot section is fed with an external hydraulic signal from a different hydraulic control system the like. The modification of FIG. 7 is constructed in such a manner that a shuttle 128 is integrally provided at a lower portion thereof with a core 162 and a solenoid 164 is arranged so as to surround the core 162. In the modification, the solenoid 164 is mounted on a body 100. In the pilot valve of the above-described construction, selective excitation of the solenoid 164 by means of a signal fed thereto from a different or external hydraulic control system or the like permits the core 162 and therefore the shuttle 128 to be forced upward in FIG. 7. Thus, it will be noted that such construction of the modification likewise exhibits substantially the same function as the input apparatus shown in each of FIGS. 5 and 6. The remaining part of the modification may be constructed in substantially the same manner as the input apparatus shown in FIG. 5.

As can be seen from the foregoing, the input apparatus of the embodiment shown in FIGS. 5 to 7 is actuated by means of an external signal fed thereto through the pilot section in addition to by operation of its own control section, to thereby exhibit an additional function.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An input apparatus comprising:

a control section, a body formed with a pump passage and an output port, push rods arranged in said body and operatively connected to said control section, elastic means arranged in said body and operatively connected to each of said push rods, a shuttle arranged in said body and operatively connected to an individual one of said push rods, said shuttle having a pressure receiving surface and being formed with a passage, pressing operation of said control section causing said shuttle to be moved through said individual one of said push rods in a one direction against said elastic means to communicate said shuttle passage with said pump passage of said body, resulting in feeding hydraulic oil from a hydraulic pump through said shuttle to said output port of said body and balancing a back pressure acting on said pressure receiving surface of said shuttle through said output port with elastic force of said elastic means to determine a position of said shuttle and a hydraulic pressure output through said output port depending on the amount of operation of said control section, and said body including a pilot section having a hydraulic signal passage communicating with said shuttle pressure receiving surface through which an external hydraulic signal can be fed to exert a force on said shuttle pressure receiving surface to move said shuttle in a second direction opposing said one direction against said elastic means and therewith provide a control of a hydraulic pressure output through said output port counteractive to that otherwise determined by a position of said individual one of said push rods.

2. An input apparatus as defined in claim 1, wherein said input apparatus is in the form of a pilot valve.

* * * * *